United States Patent [19]

Baker et al.

[11] 4,391,325

[45] Jul. 5, 1983

[54] LINER AND HYDRAULIC LINER HANGER SETTING ARRANGEMENT

[75] Inventors: Samuel F. Baker, Conroe; Ronald D. Arnold, Missouri City, both of Tex.

[73] Assignee: Texas Iron Works, Inc., Houston, Tex.

[21] Appl. No.: 201,309

[22] Filed: Oct. 27, 1980

[51] Int. Cl.[3] ..... E21B 23/04

[52] U.S. Cl. ..... 166/208; 166/212; 166/217

[58] Field of Search ..... 166/208, 212, 217, 124, 166/382

[56] References Cited

U.S. PATENT DOCUMENTS

| | | | |
|---|---|---|---|
| 2,874,784 | 2/1959 | Baker et al. | 166/212 |
| 3,011,557 | 12/1961 | Conrad | 166/212 |
| 3,528,500 | 9/1970 | Brown | 166/212 |
| 3,570,599 | 3/1971 | Wilson et al. | 166/208 |
| 3,920,075 | 11/1975 | Braddick et al. | 166/208 |
| 3,999,605 | 12/1976 | Braddick | 166/212 |

*Primary Examiner*—William F. Pate, III

*Attorney, Agent, or Firm*—Jack W. Hayden

[57] ABSTRACT

A liner and a hydraulic liner hanger setting arrangement for setting the liner in a well bore casing includes a setting tool having a tubular mandrel connected in a pipe string to extend through the hydraulic setting arrangement with the liner forming an outer housing surrounding the liner and to form a longitudinally extending annular recess therebetween with one end of the recess exposed to the well bore. Longitudinally extending piston means are sealably engaged in the recess with the piston means having a cone shaped end. Slips are releasably secured to the liner and means are provided to retain and to lock the piston means against premature retraction into the recess. A port in the housing communicates fluid pressure from the mandrel to the housing recess to move said piston means in the recess and engage the cone shaped end thereof with said slips to urge them into engagement with the well bore casing and thus secure the liner in position. Upon lowering the setting tool after the slips engage the casing, seal means on the piston means span the housing port and prevent communication to the recess from the port means when the piston is retracted back into the recess.

10 Claims, 8 Drawing Figures

LINER AND HYDRAULIC LINER HANGER SETTING ARRANGEMENT

SUMMARY OF THE INVENTION

Various types of hydraulic setting arrangements have been provided, such as illustrated at pages 4940 and 4941 of the Composite Cataloge of Oilfield Equipment and Services for 1974–1975, Volume 3. However, the arrangements heretofore employed are not necessarily constructed and arranged to withstand substantial pressures that may be encountered in a well bore and are not necessarily constructed and arranged to inhibit premature release and actuation of the hydraulic hanger means before the liner to be hung thereby is positioned at a desired elevation in the well bore.

One of the primary objects of the present invention is to provide a liner and a hydraulic hanger arrangement therefor which may be readily and easily actuated when desired, but which is also constructed and arranged so as to withstand substantial internal or burst pressure.

Another object of the present invention is to provide a liner and a hydraulic hanger arrangement therefor which is locked in position to prevent premature actuation thereof until the liner is positioned at the proper or desired position in the well bore.

Other objects and advantages of the invention will become apparent from a consideration of the following description and drawings.

DESCRIPTION OF THE PREFERRED EMBODIMENT

Figure 1:
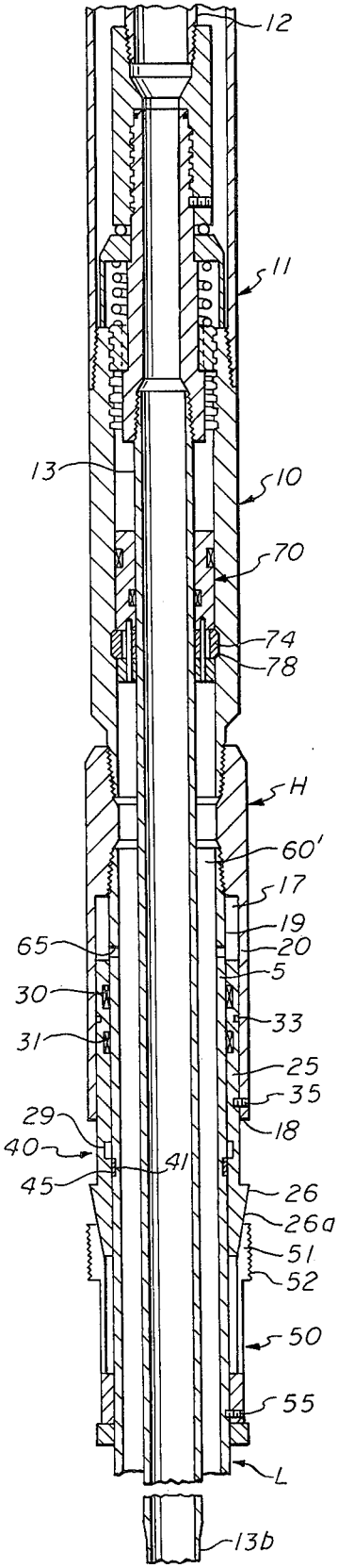
FIG. 1 is a schematic illustration of the present invention ready to be lowered into a well bore.
Figure 2:
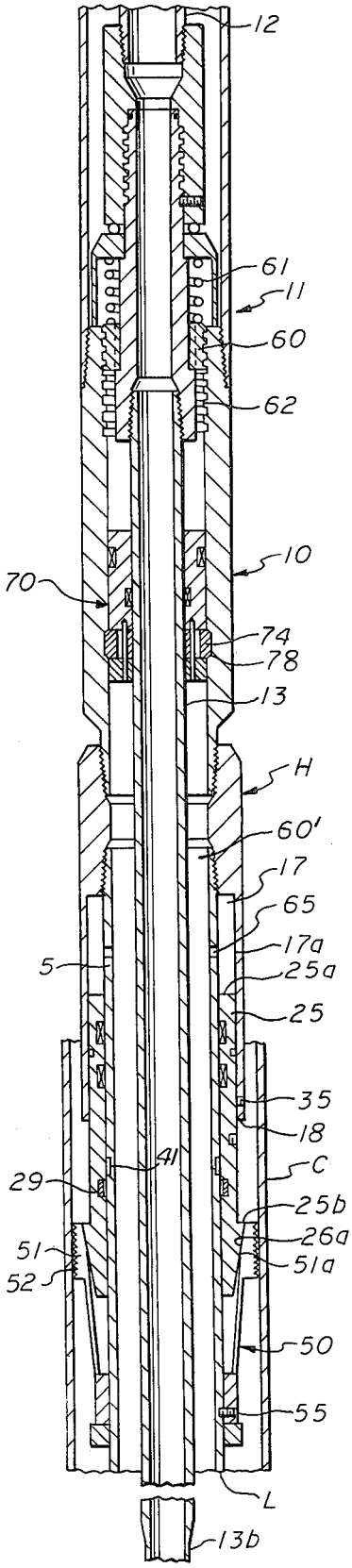
FIG. 2 is a schematic illustration similar to FIG. 1 showing the present invention actuated to engage a well bore casing and position the liner in the well bore.

Attention is first directed to FIG. 1 of the drawings wherein the upper portion 10 of the liner referred to generally at L is releasably connected by the arrangement referred to generally at 11 to a well string 12 which extends upwardly to the earth's surface and forms a setting tool to enable the liner L to be lowered into and positioned in the well bore casing C as is shown in FIG. 2 and will be described.

The setting tool arrangement includes a mandrel 13 connected to the pipe string 12 for extension through at least a portion of the liner L.

Figure 3:
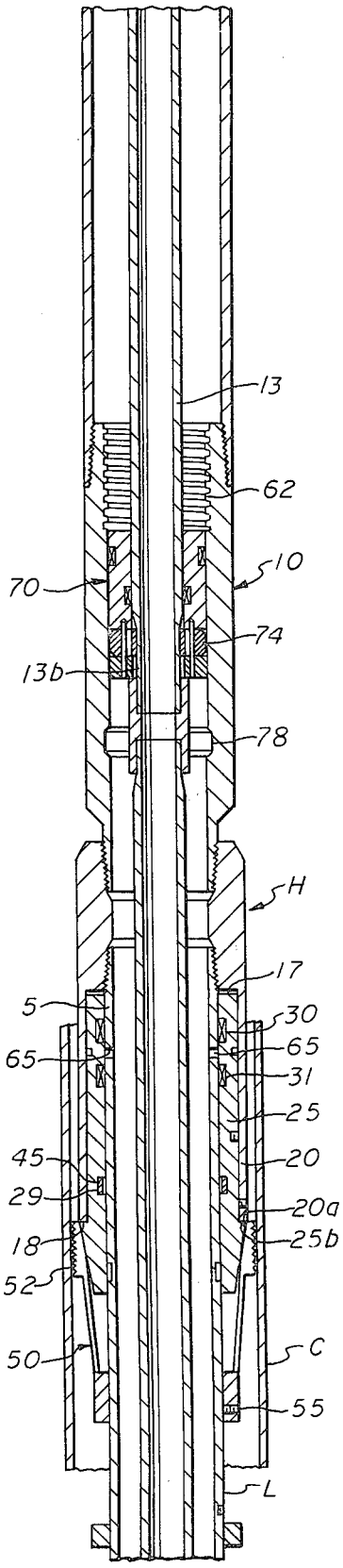
FIG. 3 is a schematic view similar to FIGS. 1 and 2 and shows the setting tool disconnected from the liner and ready to be removed from the well bore after cementing operations have been conducted in the well bore to cement the liner in place.

The upper end or portion 10 of the liner L forms an outer housing H which surrounds the mandrel 13 and liner L as shown in FIGS. 1, 2 and 3 and extends longitudinally thereof.

The housing H may be considered as including longitudinally extending tubular portion 5 of liner L which is spaced radially of the depending wall 20 to define annular recess means 17 formed between spaced inner and outer annular wall portion 19 on portion 5 of liner L and wall portion 20 as shown in FIGS. 1, 2 and 3.

Longitudinally and annularly extending piston means 25 are arranged in the recess means 17 with the lower end 26 thereof extending from the end 18 of the recess means 17 and being cone shaped as shown. Seal means 30 and 31 are provided on the piston means 25 to sealably engage with the inner wall portion 19 during movement of the piston and O-ring seal means as shown at 33 sealably engage with the outer wall portion 20. Suitable means such as shear pin means 35 extend through the outer wall portion 20 to engage with the piston means 25 to assist in initially positioning and retaining the piston means 25 within the recess 17.

Additional lock means referred to generally at 40 in FIG. 1 is provided to lock the piston means 25 in the recess 17 and inhibit upward movement thereof which would prematurely cause the seals 30 and 31 to span port 65 and thus prevent proper setting of liner L.

Figure 6:
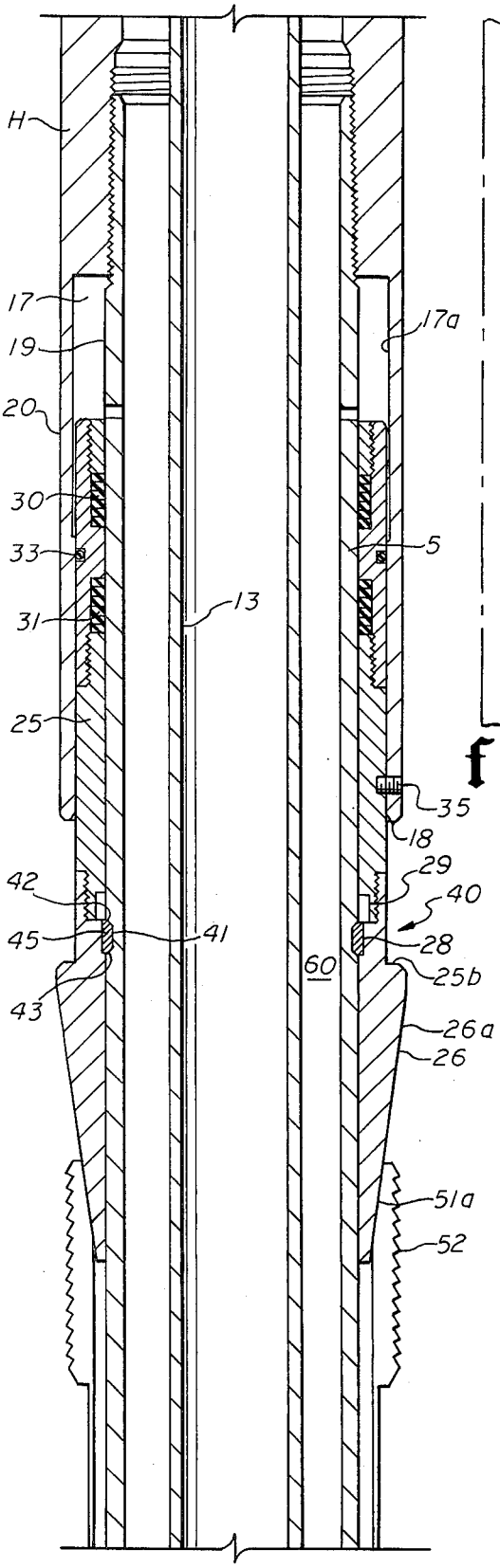
FIG. 6 is an enlarged sectional view illustrating in greater detail a portion of the liner and hydraulic liner hanger setting arrangement of the present invention with means for locking the piston and cone end thereof in position to limit movement and prevent premature actuation of the liner hanger arrangement.
Figure 8:
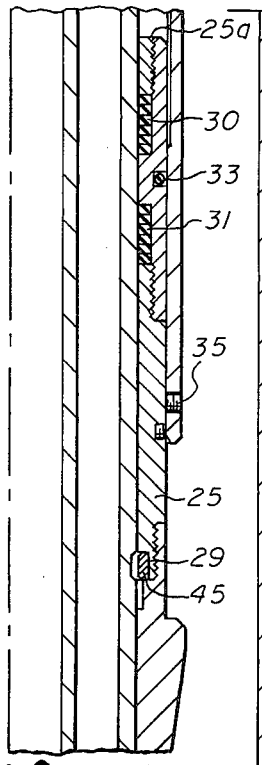
FIG. 8 is an enlarged partial sectional view illustrating the locking means of FIG. 6 in released position to enable the piston and cone end thereof to extend from the recess in the outer housing for engagement with the slips to position the liner in the well bore casing.
Figure 7:
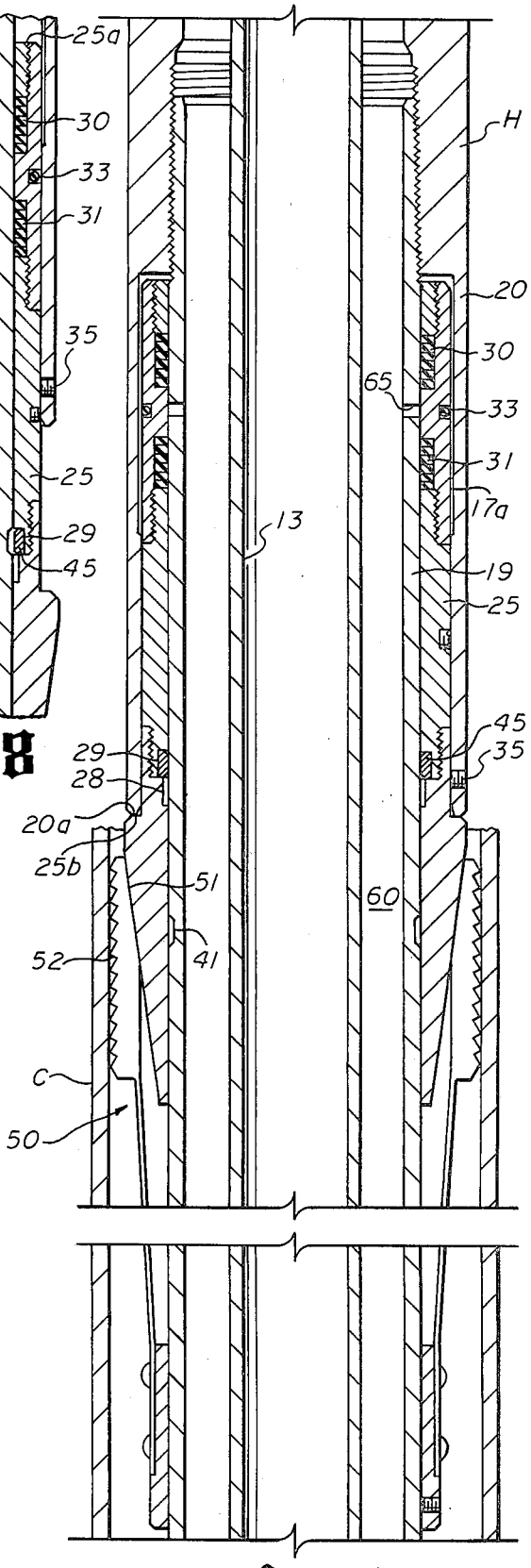
FIG. 7 is an enlarged vertical sectional view of the hydraulic liner hanger setting arrangement of the present invention showing the final position when the liner is fully hung in the casing in the well bore.

Details of the lock means 40 are better shown in FIGS. 6, 7 and 8. It includes an annular recess 41 formed on the inner wall portion 19 of the tubular member 5 of housing H which recess 41 provides shoulders 42 and 43 at each end thereof for retaining an expandable lock ring 45 in contracted position in the recess 41 when the tool is assembled as shown in FIG. 6. When the tool is thus assembled, the lock ring 45 also engages the annular undercut portion 28 on the piston means 25 to further retain the lock ring 45 in position and thus prevent premature upward movement of piston 25 in recess 17.

The piston means 25 also includes a larger annular recess 29 one end of which communicates with the recess 28 as shown in FIG. 6 of the drawings. This arrangement enables the piston means 25 to retain its position as shown in FIG. 6 and as illustrated in FIG. 1 of the drawings while the setting tool including the pipe string 12 and mandrel 10 with the liner L supported thereon are all lowered into position in the well bore casing C without effecting actuation of the device to cause premature setting of the liner L in the well bore casing C until the desired position or elevation therein is obtained.

It will be noted that the outer housing H is provided with slip means referred to generally at 50 which include slips 51 that are provided with an annular conforming tapered surface **51*a* to engage the annular tapered surface 26*a* of the cone shaped end 26 of the piston means 25 so that when the piston means 25 is unlocked from the housing H and moved downwardly, the serrated surfaces 52 thereof will expand radially to engage and grip the casing C as shown in FIGS. 2 and 3** of the drawings.

The slip means 50 are releasably secured to the lower portion of tubular member 5 forming part of the liner L by suitable means such as the shear mean 55. Thus, the slip means 50 is carried by, or attached to, the liner L while the liner L is secured in position to the casing C.

In the operation of the invention, the setting tool 12 and liner L supported thereon are lowered in the well bore casing C until the desired position in the casing C is reached at which the liner L is to be hung on the casing C. Pump pressure at the earth's surface is then increased to discharge fluid downwardly through the pipe string 12 forming part of the setting tool and through the mandrel 13 to be discharged through the liner wiper plug (not shown) which is of well known construction and the fluid is discharged upwardly in the space 60 between the mandrel 13 and the tubular member 5 of the housing H.

Port means 65 are provided in the tubular portion 5 of liner L for communicating pressure fluid to the recess 17 and end 25*a* of the piston 25, however, until the fluid pressure exerted against the end 25*a* of the piston 25 is sufficient to shear the shear pin 35, the piston means 25 will remain in the position shown in FIG. 1.

When the fluid pressure is increased to shear the shear pin 35, the piston means 25 moves downwardly as shown in FIG. 2 of the drawings. Such movement aligns the enlarged annular recess or counterbore 29 with the expandable lock ring 45 which had been previously held in collapsed position as previously described, so that the expandable lock ring 45 may then move outwardly into the recess 29 thus enabling the piston means 25 to move downwardly in response to fluid pressure on the upper end 25*a* thereof.

Such downward movement of the piston means 25 causes the conforming annular tapered surface 26*a* of the cone shaped end 26 to engage the annular conforming surface 51*a* of the slip segments 51 and expand them radially outwardly into gripping engagement with the casing C as illustrated in FIG. 2 of the drawings.

After the slip means 51 have engaged with the casing C as shown in FIG. 2 of the drawings, the fluid pressure acting in the recess 17 on the upper end of 25*a* of the piston means 25 may be released. The setting tool including the pipe string 12 may be slackened which will cause the liner L including the housing H to move downwardly relative to the piston means 25.

This causes the piston means 25 to move upwardly in the recess 17 and when the O-ring seal means 33 is aligned with the annular undercut portion 17*a*, fluid pressure in the upper end of the recess 17 is relieved through the lower end 18 of the recess to the well bore. The release of the fluid pressure in recess 17 above the piston means 25 enables the piston means 25 to move upwardly in the annular recess 17 until the lower end 20*a* of the outer surface or wall portion 20 engages the annular shoulder 25*b* formed adjacent the cone end 26 of the piston means 25 as shown in FIG. 7.

The downward movement of the liner L and housing H also shears the pin 55 which releases the slip means 50 from the liner L so that the slip means 50 remain in place between the liner L and casing C. The downward movement of housing H and liner L together also moves recess 17 downwardly so that the piston means 25 is positioned in the annular recess 17 whereby seal means 30 and 31 span the port 65 as shown in FIGS. 3 and 7 of the drawings.

Since fluid pressure from port 65 cannot bypass seals 30 or 31, any fluid pressure acting through port means 65 is counteracted by the thickness of the piston means 25 and the outer wall portion 20. This arrangement substantially increases the burst strength of the portion of the arrangement adjacent the port means 65 and provides additional strength to fluid pressures that might be encountered.

Thereafter, the connecting means 11 may be operated to disengage the setting tool including the pipe string 12 and mandrel 13 from the liner L at its upper end or housing H. Such disconnection of the connection 11 may be effected by rotating the pipe string 12 at the earth's surface whereupon the threaded means 60 will feed upwardly against the spring means 61 urging thereagainst to disengage the threaded means 60 from the threaded portion 62 in the housing H. After the connection 11 has been disengaged, suitable cementing operations may be conducted in a manner well known in the art.

Figure 4:
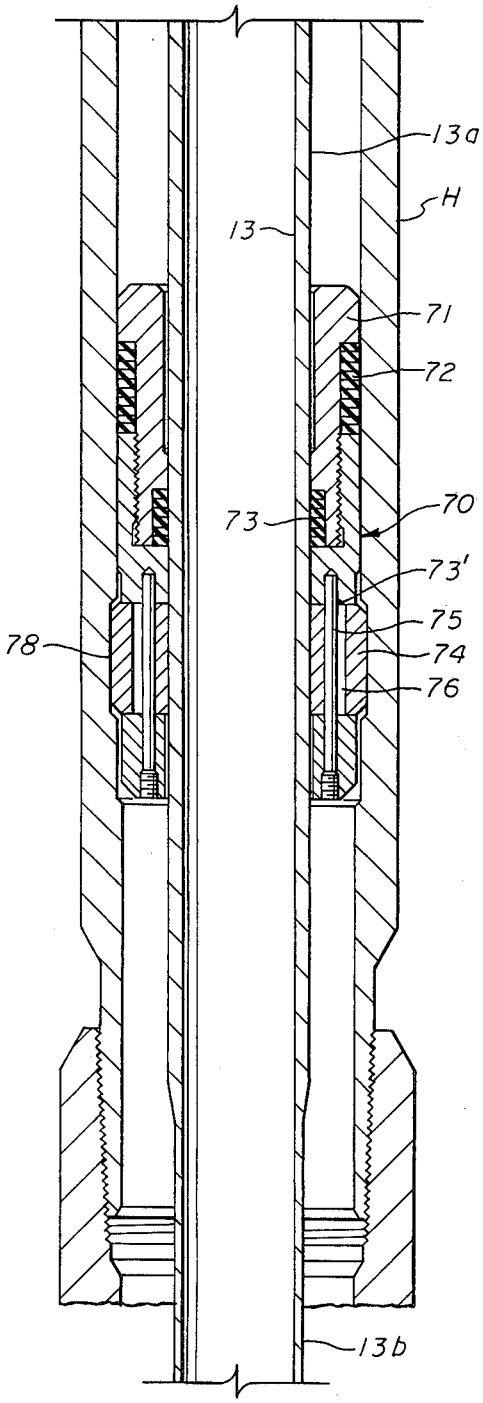
FIGS. 4 and 5 are sectional views showing a seal assembly between the liner and the setting tool.
Figure 5:
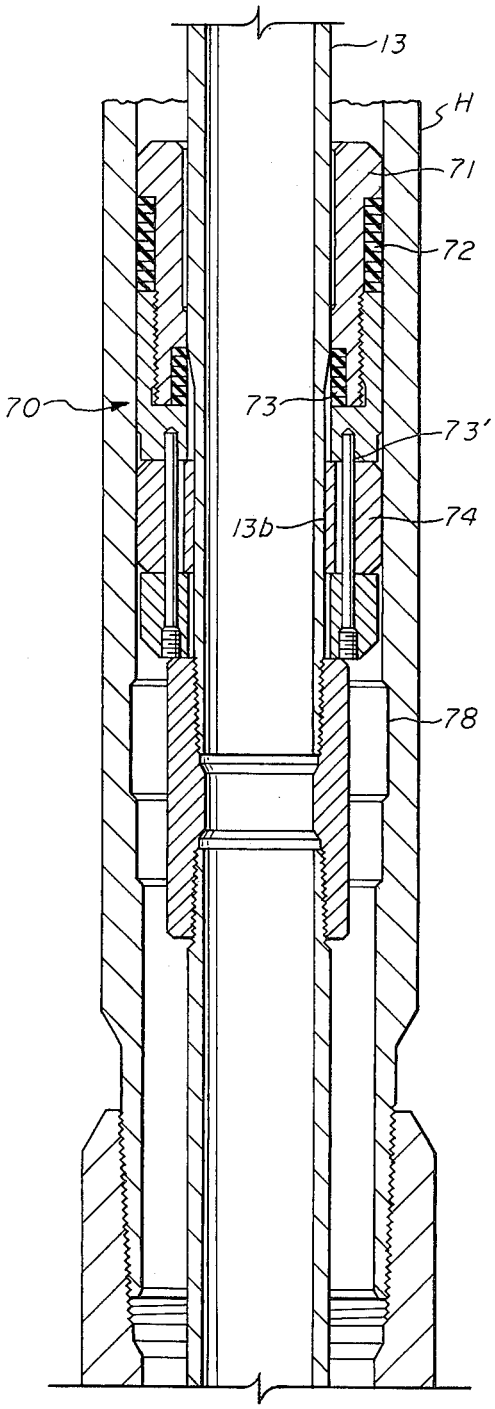

To this end, any suitable seal arrangement may be provided between the mandrel 13 and the liner L, one such suitable seal means being referred to generally by the numeral 70 in FIGS. 1 thru 3, and as shown in greater detail in FIGS. 4 and 5. The seal means 70 is positioned so as to seal between the mandrel 13 and the housing H, and is shown as including an annular body 71 having seal means 72 thereon for engaging the housing H of the liner L and seal means 73 for engaging the outer mandrel surface of as shown in the drawings. The housing 71 also includes apertures or circumferentially spaced openings 73' in which dogs or latch means 74 may move radially. They are each retained in position by means of the pin 75 which extend through the opening 76 in each dog and extend through the dogs 74, to engage in housing 71 as shown in the drawings.

The housing H also includes suitable annular recess means 78 and when the tool is initially assembled at the earth's surface, the housing 71 is positioned so that the dogs or latches 74 project outwardly into the annular recess 78 of the housing H as shown in FIG. 4 of the drawings. The mandrel 13 is provided with an exterior wall having two different diameters 13*a* and 13*b* so that as long as the wall portion 13*a* is exposed adjacent the dogs 74 they will each be urged to the position shown at FIG. 4 to retain seal assembly 70 in place between mandrel 13 and liner L.

After cementing operations have been completed, the well string including the mandrel 13 may be elevated so that the dogs 74 are adjacent the reduced diameter portion 13*b* on the mandrel 13 to enable the dogs 74 to withdraw from the recess 78 whereupon the seal means 70 may be retrieved from the well bore along with the well string 12 and mandrel 13 as shown in FIG. 3.

Other forms of seal means well known in the art may be employed such as swab cup seals or a drillable seal.

From the foregoing description, it can be seen that the present invention provides a hydraulic setting arrangement for a liner which cannot be prematurely actuated and which, after setting the liner in the well bore is constructed and arranged to withstand substantial pressures in the well bore.

The foregoing disclosure and description of the invention are illustrative and explanatory thereof, and various changes in the size, shape, and materials as well as in the details of the illustrated construction may be made without departing from the spirit of the invention.

What is claimed is:

1. In a hydraulic liner setting arrangement for setting a liner in a well bore casing wherein the setting arrangement includes a setting tool with a tubular mandrel forming part of a pipe string which is connected to, and extends into, the liner including a housing which surrounds and extends longitudinally of the liner so that the liner and housing form inner and wall portions defining an annular recess, the invention comprising:

a. longitudinally extending piston means including seal means to sealably engage said piston means in the recess and said piston means having a cone shaped end;

b. means to secure said piston means against premature upward movement into the recess;

c. slip means;

d. means releasably securing said slip means to the liner;

e. port means in the liner for communicating fluid from the tubular mandrel to the recess to move said piston means downwardly in the recess and engage said cone shaped end with said slip means and thereby urge said slip means into engagement with the well bore casing for securing the liner to the casing; and f. said seal means on said piston means including spaced seal means sealably engaging the inner wall of the recess, said piston means being retractable into the recess by lowering the setting tool and liner relative to said piston means after said slip means engages the casing, said spaced seal means being located on said piston means so as to span the housing port means to thereby seal off communication between the port means and recess.

2. The invention of claim 1 wherein said means to secure includes:

a. lock ring means between said piston means and the housing to lock said piston means for limited longitudinal movement until a predetermined fluid pressure is exerted against said piston means; and b. said piston means having recess means to receive said lock ring means upon limited longitudinal movement of said piston means whereupon further longitudinal movement of said piston means in response to fluid pressure may occur to urge said cone shaped end of said piston means against said slip means.

3. The arrangement of claim 1 including stop means on said piston means engageable with the housing to limit and position said piston means as it retracts into the recess.

4. The invention of claim 2 wherein:

a. said seal means on said piston means includes seal means to engage the outer wall surface of the recess; and b. said outer wall surface having an annular undercut portion adjacent the upper end of the recess to relieve fluid pressure from above said piston means to an end of the recess exposed to the well bore when the setting tool is lowered.

5. The invention of claim 2 including:

a. seal means releasably attached to the liner and sealingly engaging the exterior of the mandrel and the interior of the liner permitting at least limited axial movement of the mandrel without movement of said seal means;

b. latch means included with said seal means engageable with corresponding groove means within the liner to releasably hold said seal means against axial displacement therein; and c. the mandrel comprising a first portion and second portion of less diameter than said first portion, said first portion when in registration with said latch means preventing disengagement of said latch means from said groove means, said second portion when in registration with said latch means allowing disengagement of said latch means from said groove means, said second portion when in registration with said latch means allowing disengagement of said latch means from said groove means.

6. The invention of claim 1 including lock means to lock said piston means against premature retraction into the recess and thereby prevent premature spanning of said piston seal means relative to the port means.

7. Apparatus as set forth in claim 5 in which said seal means comprises tubular body means, having apertures in which latch members of said latch means are mounted for radial movement between extended positions, in which said latch members engage said groove means, and retracted positions, in which said latch members are not in engagement with said groove means, said mandrel being movable between a first position engaging and holding said latch members in said extended positions, and a second position permitting said latch members to move to said retracted positions.

8. A liner for securing with a well bore casing by a setting tool having a tubular mandrel connected in a pipe string for extension through the liner comprising:

a. a longitudinally extending housing secured to and surrounding the liner in spaced radial relation adjacent an end of the liner;

b. said housing and liner forming a longitudinally extending annular recess therebetween defining spaced inner and outer wall portions with one end of the recess exposed to the well bore;

c. longitudinally extending piston means including seal means to sealably engage said piston means in the recess and said piston means having a cone shaped end;

d. slip means releasably secured to the liner;

e. port means in the liner for communicating fluid from the mandrel to the recess to move said piston means and engage said cone shaped end with said slip means to urge them into engagement with the well bore casing;

f. said seal means on said piston means including spaced seal means sealably engaging the inner wall of the recess, said piston means being retractable into the recess by lowering the setting tool and liner relative to said piston means after said slip means engages the casing, said spaced seal means being located on said piston means so as to span the housing port means to thereby seal off communication between the housing port means and recess;

g. said piston means including shoulder means to engage the housing to limit and position said piston means in the recess as it retracts thereinto; and h. lock means to lock said piston means against premature retraction into the recess to prevent premature spanning of the port means by said spaced seal means.

9. The invention of claim 8 wherein said lock means includes:

a. lock ring means between said piston means and said outer housing to lock said piston means for limited longitudinal movement until a predetermined fluid pressure is exerted against said piston means; and b. said piston means having recess means to receive said lock ring means upon limited longitudinal movement of said piston means whereupon further longitudinal movement of said piston means in response to fluid pressure may occur to urge said cone shaped end of said piston means against said slip means to move them into engagement with the well bore casing.

10. The invention of claim 8 wherein:

a. said seal means on said piston means includes seal means to engage the outer wall surface of the recess; and b. said outer wall surface having an annular undercut portion adjacent the upper end of the recess to relieve fluid pressure from above said piston means to the end of said housing recess exposed to the well bore when the setting tool is slackened.

* * * * *